US007431285B1

(12) United States Patent
Nissim

(10) Patent No.: US 7,431,285 B1
(45) Date of Patent: Oct. 7, 2008

(54) VIBRATORY SHEET JOGGER FOR JOGGING AND ALIGNING SHEETS OF PAPER INCLUDING CHECKS

(75) Inventor: Yosi Nissim, West Hills, CA (US)

(73) Assignee: Y. Nissim, Inc., Chatsworth, CA (US)

( * ) Notice: Subject to any disclaimer, the term of this patent is extended or adjusted under 35 U.S.C. 154(b) by 259 days.

(21) Appl. No.: 11/488,807

(22) Filed: Jul. 17, 2006

(51) Int. Cl.
*B65H 3/62* (2006.01)

(52) U.S. Cl. ..... 271/146; 271/210; 221/200; 221/201; 221/202; 221/203; 221/204; 221/205

(58) Field of Classification Search ..... 271/146, 271/210; 221/200, 201, 202, 203, 204, 205
See application file for complete search history.

(56) References Cited

U.S. PATENT DOCUMENTS

| | | | | | |
|---|---|---|---|---|---|
| 2,624,577 | A | | 1/1953 | Peugnet | |
| 2,883,191 | A | | 4/1959 | Peugnet | |
| 3,222,060 | A | | 12/1965 | Svantesson | |
| 3,240,492 | A | | 3/1966 | Hoff | |
| 3,559,984 | A | | 2/1971 | Westra | |
| 3,862,752 | A | * | 1/1975 | Totten | 271/210 |
| 3,982,751 | A | | 9/1976 | Obenshain | |
| 4,232,860 | A | * | 11/1980 | Brown | 271/119 |
| 4,371,155 | A | | 2/1983 | Astero | |
| 4,544,002 | A | * | 10/1985 | Aronson | 140/89 |
| 4,858,907 | A | * | 8/1989 | Eisner et al. | 271/124 |
| 4,973,037 | A | * | 11/1990 | Holbrook | 271/2 |
| 5,259,609 | A | * | 11/1993 | Brame et al. | 271/213 |
| 6,056,288 | A | * | 5/2000 | Tsai et al. | 271/213 |
| 6,234,471 | B1 | * | 5/2001 | Tranquilla | 271/149 |
| 6,299,159 | B1 | * | 10/2001 | Battle et al. | 271/221 |
| 6,585,255 | B2 | * | 7/2003 | Evansic | 271/146 |
| 6,695,304 | B1 | | 2/2004 | Werner | |
| 6,978,990 | B2 | | 12/2005 | Silverbrook | |
| 7,025,347 | B2 | * | 4/2006 | Masui et al. | 271/241 |
| 2006/0273106 | A1 | * | 12/2006 | Kim | 221/200 |
| 2008/0088081 | A1 | * | 4/2008 | Miwa et al. | 271/210 |

* cited by examiner

*Primary Examiner*—Patrick Mackey
*Assistant Examiner*—Prasad V Gokhale
(74) *Attorney, Agent, or Firm*—Thomas I. Rozsa

(57) ABSTRACT

The present invention is a vibratory sheet jogger which is used to jog and separate sheets of paper such as bank checks so that the sheets of paper and/or bank checks can be aligned. To achieve this result, a vertically jogging motion of a sheet tray is generated from a mechanical combination of an eccentric pulley assembly driven by a DC motor and a slotted ring comprising a slotted bore affixed to the sheet tray of the jogger. Specifically the combination includes a ball bearing with the eccentric pulley inserted into the slotted bore of the slotted ring, wherein the height of the slotted bore matches the outside diameter of the ball bearing, and the length of the slotted bore is larger than the diameter of the ball bearing.

20 Claims, 6 Drawing Sheets

VIBRATORY SHEET JOGGER FOR JOGGING AND ALIGNING SHEETS OF PAPER INCLUDING CHECKS

BACKGROUND OF THE INVENTION

1. Field of the Invention

The present invention relates generally to a vibratory sheet joggers which are used to vibrate sheets of paper in order to align them and separate them.

2. Description of the Prior Art

The following 10 patents are the closest prior art references to the present invention of a vibratory sheet jogger.

1. U.S. Pat. No. 2,624,577 issued to William R. Peugnet on Jan. 6, 1953 for "Paper Jogging Machine" (hereafter the '577 Peugnet patent);

2. U.S. Pat. No. 2,883,191 issued to William R. Peugnet on Apr. 21, 1959 for "Paper Jogging Machine" (hereafter the '191 Peugnet patent);

3. U.S. Pat. No. 3,222,060 issued to Ake W. Svantesson on Dec. 7, 1965 for "Jogging Machine" (hereafter the '060 Svantesson patent);

4. U.S. Pat. No. 3,240,492 issued to Wally Charles Hoff on Mar. 15, 1966 for "Jogger" (hereafter the '492 Hoff patent);

5. U.S. Pat. No. 3,559,984 issued to Dan P. Westra on Feb. 2, 1971 for "Jogging Apparatus" (hereafter the '984 Westra patent);

6. U.S. Pat. No. 3,982,751 issued to David Noel Obenshain on Sep. 28, 1976 for "Parallel Action Jogger" (hereafter the '751 Obenshain patent);

7. U.S. Pat. No. 4,371,155 issued to Ulf J. E. Astero and assigned to Asthausbolagen HB Astero 7 Stockhaus on Feb. 1, 1983 for "Apparatus For Jogging A Sheaf of Papers" (hereafter the '155 Astero patent);

8. U.S. Pat. No. 6,299,159 issued to William Froman Battle and assigned to Unisys Corporation for "Direct Current Miniature Paper Jogger" (hereafter the '159 Battle patent);

9. U.S. Pat. No. 6,695,304 issued to Todd C. Werner and assigned to Pitney Bowes Inc. on Feb. 24, 2004 for "Vibrating Means For Aligning Envelopes In A Hopper" (hereafter the '304 Werner patent);

10. U.S. Pat. No. 6,978,990 issued to Kia Silverbrook and assigned to Silverbrook Research Pty Ltd on Dec. 27, 2005 for "Binding Assembly For Binding Sheets Incorporating An Alignment Mechanism" (hereafter the '990 Silverbrook patent").

The '577 Peugnet patent discloses, an electric motor 21 having an eccentric weight 22 attached to its shaft which is mounted on the exterior surface of the bottom 11 by means of screws 23. The motor is mounted so that its rotational axis lies at an angle to the horizontal flanges of the angle strips 18 and 19, and also lies in a fore and aft vertical plane which passes through the center of gravity of the cradle. It is also preferably positioned so that the weight 22 is located either forward or aft of a vertical line passing through the center of gravity of the cradle assembly, which includes the attached motor. The patent further concludes: Since the axis of rotation of the eccentrically mounted weight 22 lies at an angle to the horizontal, forces emanate therefrom in planes substantially parallel to the cradle end wall 12. As a result of the described relative locations of centers X, Y and Z, movement of the cradle at the upper end of its bottom 1 is almost entirely a transverse or lateral reciprocating motion.

The '191 Peugnet patent discusses a paper jogging machine utilizing a vibratory motion to align the edges of a stack of paper sheets. As disclosed in the patent, the springs cooperate with the strips 31 and 33 of the cabinet to resiliently suspend and support the vibration-producing structure comprising the table 20, an electric motor 39, and an eccentrically-weighted pulley 40 driven by the motor, and Upon energization of the electric motor, the eccentrically-weighted pulley will rotate to impart a vibratory action to the table 20, and through the medium of the hinge 19, to the paper holding tray 10.

The '060 Svantesson patent discloses a jogging machine for aligning sheets of material such as paper. The concept of this patent is based on an electric motor having a shaft 10a carrying an eccentric weight 10b which is secured by means of a flange 10c to the table 5 with bolts 9. The axle of the shaft 10a extends substantially perpendicularly to the table 5 and has its front end positioned within a housing 11 which is situated just below the table 5. An eccentric weight 10b is fastened to the front end of the shaft 10a within the housing 11 and when the shaft is rotated, the weight produces vibrations causing the vibration of the table in its own plane.

The '492 Hoff patent discloses a shaft rotates weights 30 and 31 which will cause the same to adopt an eccentric orbit about the axis of the shaft 24 which of course, remains on its predetermined alignment at all times. The eccentric movement of shaft 27 will be communicated through roller bearings 28 to plate 18 which will thus be forced to move around the same eccentric orbit. In this way, the stack of paper resting on brackets 16-16 will be rapidly shaken and the sheets of paper therein will quickly become aligned.

The '984 Westra patent states that it is an object of the invention to provide a jogging apparatus employing an off center weighted shaft to impart vibration to the table or tray wherein the off center weights and, thus, the degree of vibration of the apparatus, can be readily adjusted by the operator. The patent further discloses an adjustable weight housing on either side of the shaft 81 of the motor so it can be weighted to one side or the other side to create an offset vibration pattern.

The '751 Obenshain patent discloses a drive motor 4, particularly as shown in FIG. 4, is preferably a double shaft D.C. motor of compact design. In use, the motors are supplied with ordinary household AC current through solid state SCR controllers. Each end of shaft 30 of the drive motor 4 has attached thereto an eccentric disc 31 that rotates inside the housing 17 and is spaced therefrom by a bearing 33. When driven by the motor 4, the housings 17 at each side of the motor are displaced with an oscillating motion which is translated to the rest of the jogging paddle mounting system through the eccentric springs 23 and connecting bars 16. Referring to Column 5, Line 7, the patent states "Therefore, when the motor is actuated to drive the shafts 30, the eccentric discs rotate producing an oscillating motion to the housings 17."

The '155 Astero patent discloses another variation on an apparatus for jogging paper, wherein the vibration means 20 and 21 is adapted to give the compartment a vertical vibration component as well as a horizontal vibration component, which latter intersects the side wall plane of the compartment at an oblique angle. The vibratory movement is preferably shaped as a standing pear as seen in a vertical plane normal to the side wall plane. The other side wall (4) is movable towards said one side wall (4) under the influence of the vibration. Specifically, the vibration means 2 comprises a motor 21 which is attached to the bottom of the compartment 1 and which is provided with an imbalanced weight 20. The motor axis is oriented horizontally and extends at nearly a right angle to the side wall plane. The motor 21 is adapted, in coaction with springs 9, to give the compartment a vibration in a vertical direction as well as in a horizontal direction, which latter intersects the side wall 3 at an oblique angle.

The '159 Battle patent discloses a vibration system 30 which preferably includes a DC motor 31 coupled to the housing 40. The DC motor 31 rotates a shaft 32 in response to the DC power. It can further be seen that an offset flywheel 33 is coupled to the shaft 32 such that rotation of the shaft 32 transfers vibratory motion to the housing 40. Turning to FIGS. 4A and 4B, the generation of vibratory motion can be better appreciated. FIG. 4A is a side view of the motor 31, shaft 32 and offset flywheel 33 as they relate to the housing 40. As best seen in FIG. 4B, rotation of shaft 32 causes non-concentric rotation of the offset flywheel 33. The non-concentric rotation causes vibratory motion in the motor 31 which is transferred to the housing 40.

The '304 Werner patent is a vibrating means for aligning envelopes in a hopper. Specifically, the device discloses an envelope alignment of a vertical stack of envelopes in an envelope hopper which is maintained by mechanically vibrating a preselected part of the hopper. In a first embodiment, the vibration is caused by a reciprocating shuttle having a wedge-shaped member attached to it. The reciprocating shuttle and wedge member are positioned at the bottom of the hopper so that the shuttle and wedge-shaped member support all of the envelopes. The reciprocation of the shuttle and hence the reciprocation of the wedge-shaped member continually jostles the envelopes. The wedge-shaped member ejects the lowermost envelope in the hopper when the reciprocating shuttle is displaced from a retracted position to an extended position. A motor is used to cause continuous reciprocation of the shuttle. In alternative embodiments, different parts of the envelope hopper are vibrated by any suitable vibration-causing member. Specifically, the patent discloses that a small motor 40, as depicted in FIG. 5, having a cam mounted on its output shaft, is mounted adjacent back wall 13 with the cam bearing against said wall so that said wall is vibrated as the motor operates.

The '990 Silverbrook patent discloses a binding mechanism for binding sheets incorporating an alignment mechanism. The vibration imparting mechanism is operatively engaged with the support structure and is operable to vibrate the support structure. Specifically, the floor of the tray 11 has a lower-most corner 23 beneath which a vibrator 19 is positioned. The vibrator 19 is a subsonic vibrator (i.e. a vibrator having a frequency below 20 hz) or an out-of-balance electric motor.

While the general concept of vibratory sheet joggers is disclosed in the prior art, there is a need to significantly improve the operation of these vibratory sheet joggers.

SUMMARY OF THE INVENTION

The present invention is a vibratory sheet jogger which is used to jog and separate sheets of paper such as bank checks so that the sheets of paper and/or bank checks can be aligned. To achieve this result, a vertically jogging motion of a sheet tray is generated from a mechanical combination of an eccentric pulley assembly driven by a DC motor and a slotted ring comprising a slotted bore affixed to the sheet tray of the jogger. Specifically the combination includes a ball bearing with the eccentric pulley inserted into the slotted bore of the slotted ring, wherein the height of the slotted bore matches the outside diameter of the ball bearing, and the length of the slotted bore is larger than the diameter of the ball bearing.

It is an object of the present invention to provide a vibratory sheet jogger such that a sheet tray of the jogger can jog vertically, wherein the vertical jogging motion is generated from a mechanical combination of an eccentric pulley assembly driven by a DC motor and a slotted ring comprising a slotted bore affixed to the sheet tray of the jogger, wherein a ball bearing with an eccentric pulley is inserted into the slotted bore of the slotted ring and designed such that the height of the slotted bore matches an outside diameter of the ball bearing, and the length of the slotted bore is larger than the diameter of the ball bearing.

It is a further object of the present invention to create a vibratory sheet jogger wherein the vibration is created by the combination of an eccentric pulley mounted on the shaft of a DC motor which generates the vibratory effect and a ball bearing connected o the eccentric pulley wherein the ball bearing can move in a lateral direction to generate a vertical vibratory jogging action to a tray to which it is attached, the tray housing the sheets of paper or checks to be jogged and vibrated.

It is also an object of the present invention to disclose a vibratory sheet jogger, wherein variation of a jogging time can be electronically controlled.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
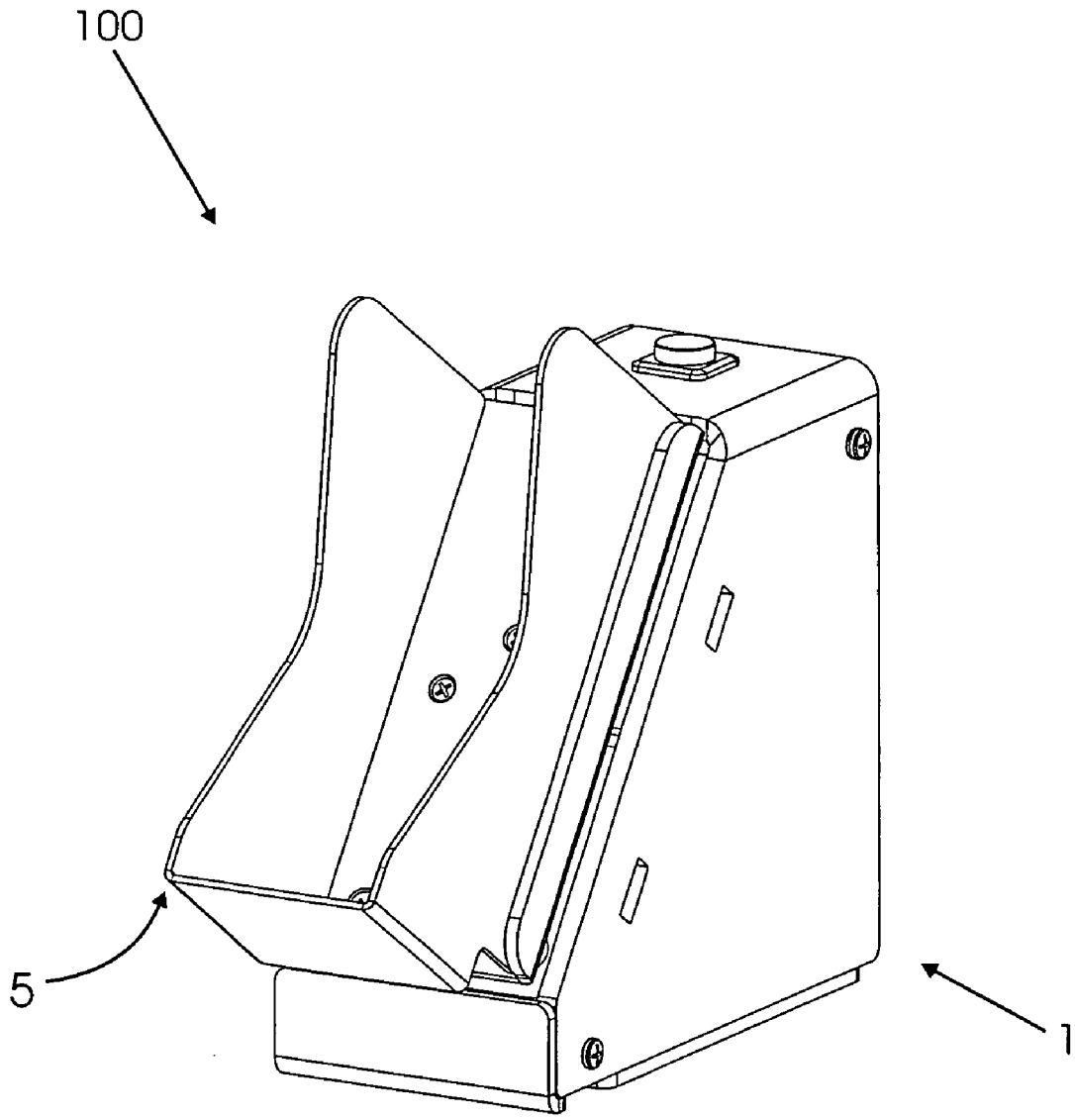
FIG. 1 is a perspective front view of the present invention vibratory sheet jogger.
Figure 2:
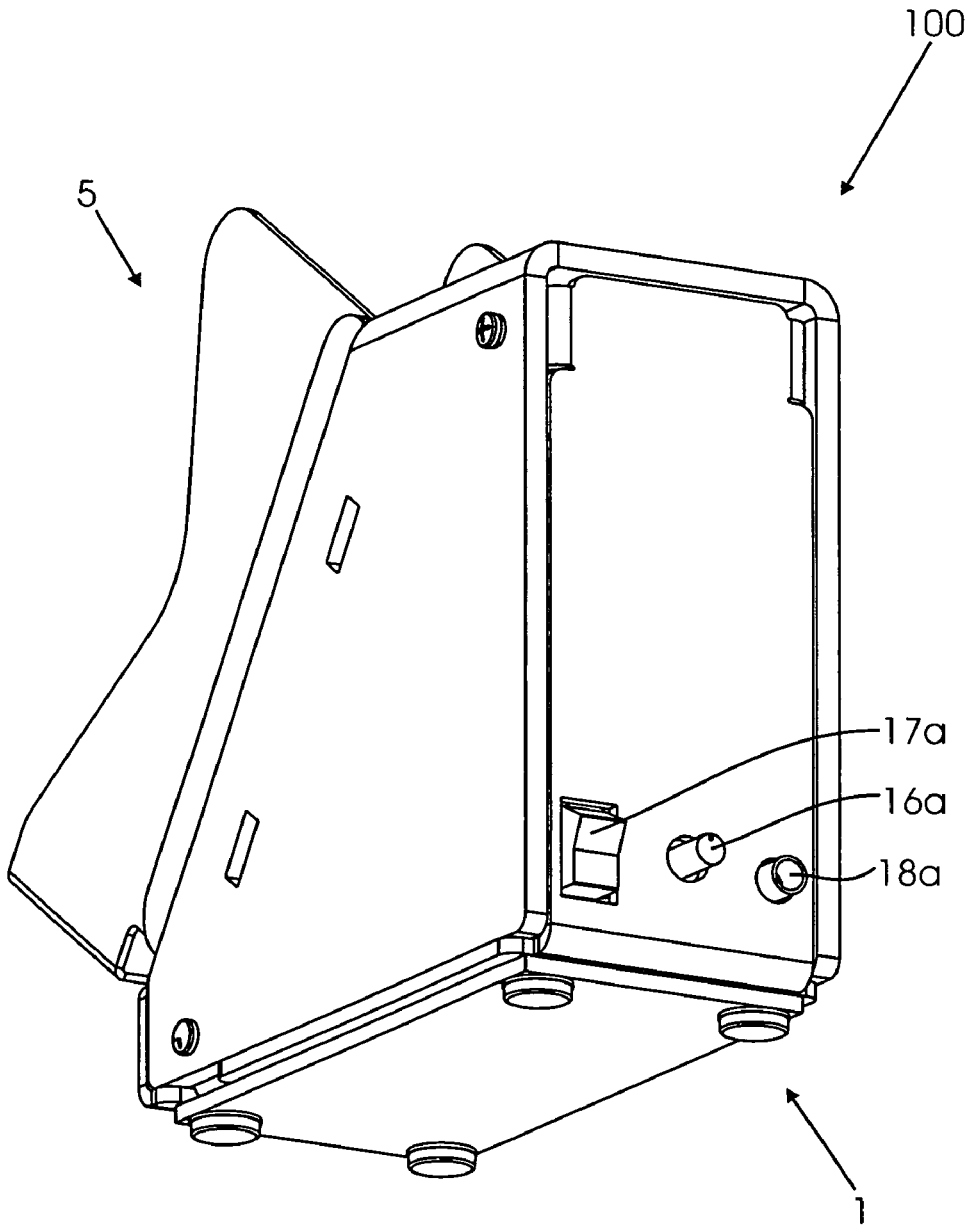
FIG. 2 is a perspective back view of the present invention vibratory sheet jogger.

Referring initially to FIGS. 1 and 2, there is illustrated the present invention of a vibratory sheet jogger 100. As illustrated from the perspective front and back views, one preferred embodiment of the vibratory sheet jogger 100 is generally composed of a jogger stand 1 and a paper sheet tray 5.

Figure 3:
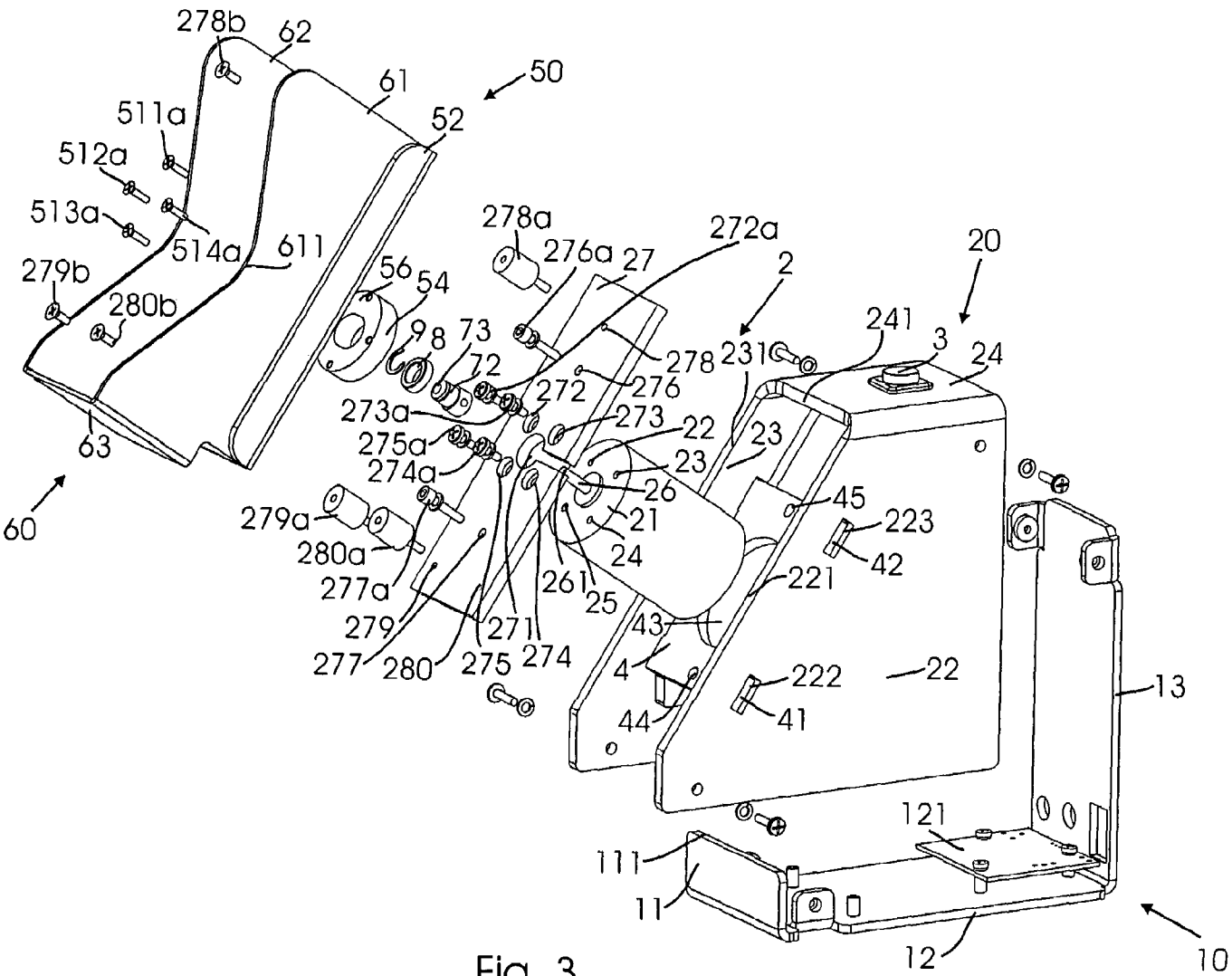
FIG. 3 is a an enlarged exploded perspective view of the present invention vibratory sheet jogger shown in the embodiment of FIG. 1.

Referring to FIGS. 1 and 3, the present invention vibratory sheet jogger 100 is illustrated from an enlarged exploded perspective view in FIG. 3. As illustrated, the stand 1 includes a stand base cover 10 and body cover 20. The sheet tray 5 contains a base 50 and side wall 60. The stand base cover 10 is generally a sheet structure bent to have a transverse front plate 11, a middle elongated rectangular horizontal plate 12 and back vertical plate 13. Said middle plate 12 further comprises two square shaped plates transversely connected at respective right and left front ends of the respective right and left elongated edges of the middle plate, wherein each vertical square shaped plate has a threaded hole for use in connection of the stand cover. Similarly, two spaced apart square shaped plates which are the same shape are located at respective ends of the top side of the vertical plate and are used to connect the vertical plate to the body cover 20. A printed circuit board 121 is affixed onto the middle plate 12 through three supporting screws and nuts so that it lies parallel to the middle plate. The stand body cover 20 is also a sheet structure bent to have an identical right and left side plate 22 and 23. Said right and left side plates transversely connect a top plate 24 containing an electrical switch 3 for initiating the jogging action of the vibratory jogger. In a preferred embodiment, the switch 3 has an LED 15 (see FIG. 7) on the top. The right side plate 22 is generally a rectangular trapezoid, comprising a front downwardly slanting front edge 221, two aligned slots 222 and 223 aligned which are parallel to said front edge 221, wherein the slots 222 and 223 are between the respective front end and top of said right side plate 22. The left side plate 23 is a mirror image of the right side plate 22, also having a downwardly slanting front edge 223 and two spaced apart slots which are respectively parallel to slots 222 and 223.

Further referring to FIG. 3, there is illustrated a supporting plate 4 between the right and left plates 22 and 23, comprising a central hole 43 and a pair of top and bottom threaded screw holes 45 and 44 respectively located on an elongated centerline of the supporting plate 4, and respectively adjacent to the top and bottom ends of the supporting plate 4. The supporting plate 4 is installed to connect the respective right and left sidewall plates 22 and 23 of the stand body cover 20 through a right side pair of tongues 41 and 42 of said plate 4 inserted through respective slots 222 and 223 of the right side wall 22, and a left side pair of tongues inserted through a respective pair of two slots of the left side wall (not shown). It will be appreciated that the supporting plate 4 is installed parallel to the right and left front edge 221 and 231 and further lies perpendicularly to both the right and left side plates 22 and 23.

Referring to FIG. 3, a DC motor 2 is illustrated which comprises a cylindrical body with a front end surface 21 having four threaded screw holes 22, 23, 24, and 25, and a rotational shaft 26 perpendicular to said front end surface 21.

Figure 4:
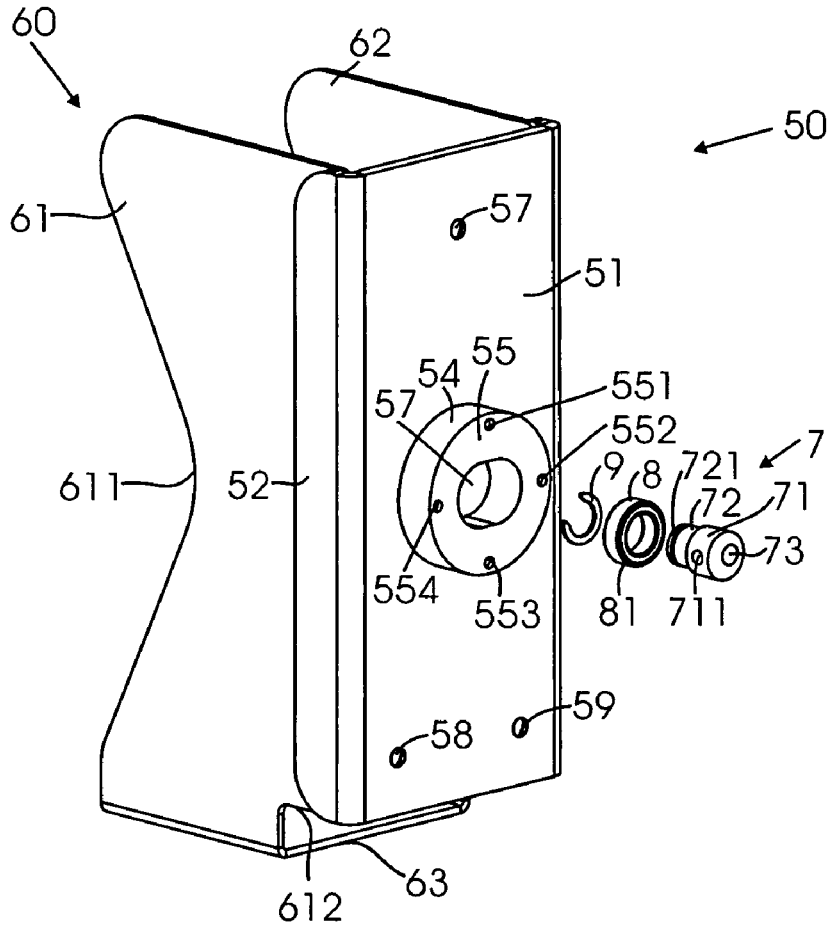
FIG. 4 is a perspective back view of a paper sheet tray of the present invention vibratory sheet jogger.
Figure 4A:
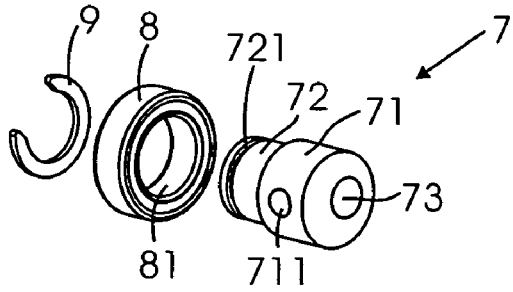
FIG. 4A is an enlarged exploded perspective view of the eccentric pulley assembly shown in the embodiment of FIG. 4.
Figure 6:
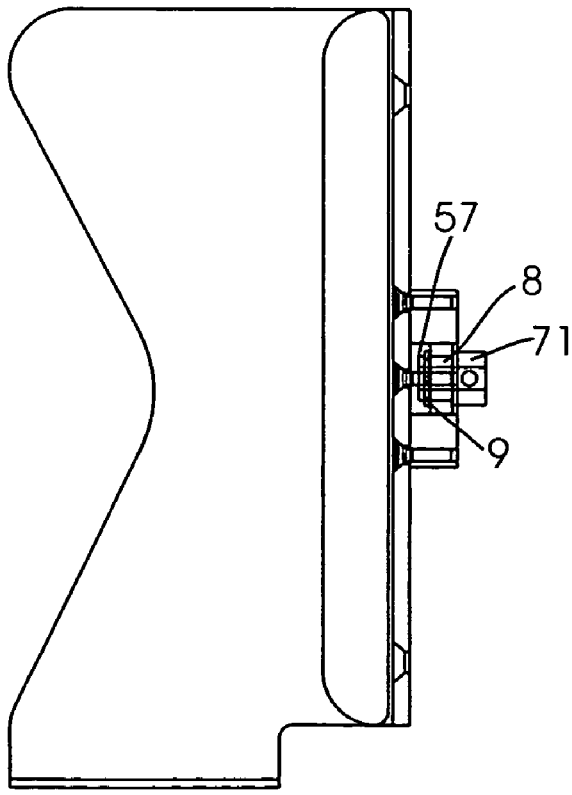
FIG. 6 is a side view of a paper sheet tray of the present invention vibratory sheet jogger.

Referring to FIG. 3 and further disclosed in FIGS. 4A and 6, there is illustrated the installation of an eccentric pulley assembly containing an eccentric pulley 7, a ball bearing 8, and a lock washer 9 placed onto a front end 261 of the rotational shaft 26 of the DC motor 2. The eccentric pulley 7 is illustrated in FIG. 4A and comprises a cylindrical head 71 coaxially connected with a cylindrical shoulder 72, wherein the outside diameter of the cylindrical shoulder 72 is smaller than the outside diameter of the cylindrical head 71. The cylindrical head 71 also comprises a round eccentric bore 73, wherein a rotational axis of the bore 73 is parallel to but positioned off the center rotational axis of the cylindrical head 71. In a preferred embodiment, the rotational center of the bore 73 is at forty-five one thousandths ($^{45}/_{1000}$) of an inch off the center of the cylindrical head 71. As further illustrated in FIG. 4A, there is a screw threaded hole 711 on an outer cylindrical surface of the cylindrical head 71, wherein said hole penetrates the head and transversely connects with the bore 73. It will be appreciated that the diameter of the bore 73 matches that of the shaft 26 of the motor 2, so that the front end 261 of the shaft 26 can be inserted into the bore 73. It will be further appreciated that a screw (not shown) through the threaded hole 711 can lock a front end 261 of the shaft 26 inside of the bore 73. Referring to FIG. 4 again and as disclosed in FIGS. 3 and 6, there is illustrated that the ball bearing 8 has a central bore 81 which connects around the cylindrical shoulder 72 of the eccentric pulley 7, and the lock washer 9 locks the bearing 8 wherein the washer is inserted into a circular slot 721 at the end of the shoulder 72 of the eccentric pulley 7.

Referring another to FIG. 3, there is illustrated an elongated rectangular motor plate 27 for installation of the motor 2, wherein the size of the plate matches a elongated rectangular opening of the body cover 20 of the stand 1. The opening is bounded by a front edge 241 of the top plate 24, the downwardly slanted edges 221 and 231 of respective right and left side plates 22 and 23, and a top edge 111 of the front transverse plate 11 of the stand base cover 10. The motor plate 27 further comprises a central large hole 271 symmetrically surrounded by four screw holes 272, 273, 274, and 275, a pair of holes 276 and 277 located at the elongated centerline line of the motor plate 27 and further positioned equidistant relative to the central hole 271, a single hole 278 close to the top end of the plate and two spaced apart holes 279 and 280 located adjacent to the bottom end of the plate 27.

As illustrated in FIG. 3, said four screw holes 272, 273, 274, and 275 of the motor plate 27 are respectively aligned with the four threaded screw holes 22, 23, 24, and 25 on the top end surface 21 of the motor 2, and said pair of holes 276 and 277 are respectively aligned with the pair of respective threaded screw holes 45 and 44 of the supporting plate 4. It will be appreciated that, with aid of these screw and threaded holes, the DC motor 2 can be installed onto the motor plate 27, wherein four screws 272*a*, 273*a*, 274*a*, and 275*a* are respectively inserted through the four holes 272, 273, 274, and 275 to be respectively threaded into the corresponding four threaded holes 22, 23, 24, and 25 on the front end surface 21 of the DC motor 2. Thus the motor 2 can be installed into the stand body cover 20, wherein the motor cylindrical body is inserted into the central hole 43 of the supporting plate 4, and the motor plate 27 is joined to the supporting plate 4 through a pair of screws 276*a* and 277*a* respectively inserted through respective holes 276 and 277 of the motor plate 27 to be respectively treaded into screw holes 45 and 44 of the supporting plate 4.

As further illustrated in FIG. 3, three identical soft rubber mounts 278*a*, 279*a*, and 289*a* are utilized to elastically join the sheet tray 5 and the jogger stand 1. The rubber mount 278*a* comprises a cylindrical body and rod coaxial to the cylindrical body. The rod of the mount is threaded into the threaded hole 278. Similarly, two additional soft rubber mounts 279*a* and 280*a* are threaded into the respective threaded holes 279 and 280 of the motor plate 27.

Referring to the sheet tray structure in FIG. 3 and also illustrated in FIG. 4, the sheet tray 5 is generally a cuboid shape, comprising a tray base 50 and a top opened enclosure 60. The tray base 50 comprises a central elongated rectangular plate having a respective front surface (not shown) and back surface 51, wherein the central plate is transversely attached by respective right and left elongated strips 52 and 53 (not shown) to respective right and left side elongated edges of the rectangular plate. The tray base 50 further comprises a top screw hole 57 adjacent to the top edge of the central plate, and two spaced apart bottom screw holes 58 and 59 located adjacent to the bottom edge of the base, wherein said top screw hole 57 and two bottom screw holes 58 and 59 are respectively aligned with the top soft rubber support 278*a* and two bottom soft rubber supports 280*a* and 279*a* on the motor support plate 27. The top opened enclosure 60 is illustrated in FIG. 3. It is a sheet structure bent to contain a short bottom plate 63 and elongated right and left side plates 61 and 62. The left and right side plates are identical and are positioned so as to be mirror image positions for each other. Said right side plate 61 has a straight top and bottom edge and a straight rear edge but also contains a convex curved front edge 611. As illustrated in FIG. 4, the rear has a stepped lower rear edge 612.

As illustrated in FIG. 4, the top opened enclosure 60 transversely attaches to the tray base 50 to form the sheet tray 5. In the attachment, the right side plate 61 of the top opened enclosure transversely connects to the tray base 50 wherein the right straight edge of the plate 61 contacts the front surface of the central elongated rectangular plate of the tray base 50, and the outside surface of the right side plate 61 further connects with the left inner side of the right side elongated strip 52 of the tray base 50. It will be appreciated that the left side plate 62 attaches to the tray base 50 in a similar way since the left side plate 62 is a mirror image of the right side plate 61. As a result of the attachment, the majority of the bottom edges from the right and left side plates 61 and 62 form a back side of the bottom plate 63.

Figure 5:
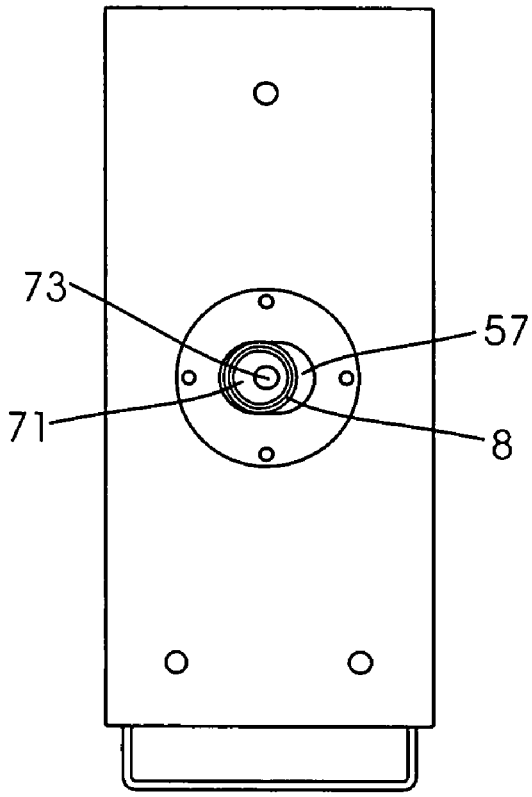
FIG. 5 is a back view of a paper sheet tray of the present invention vibratory sheet jogger.

Referring to FIGS. 3, 4, and 5, there is illustrated a slotted ring 54 affixed onto the back side 51 of the sheet tray 5. The slotted ring 54 comprises a central slotted bore 57, front and back ring surfaces 55 and 56, and four threaded screw holes 551, 552, 553 and 554, wherein each screw hole is 90 degrees apart. As illustrated in FIG. 3, four screws 511*a*, 512*a*, 513*a* and 514*a* are respectively inserted through corresponding four holes (not shown) on the central elongated rectangular plate of the tray base 50 and are respectively threaded into holes 551, 552, 553 and 554 on the slotted ring 54.

Referring to FIGS. 3, 4, 5 and 6 again, there is illustrated installation of the paper sheet tray 5 to the stand 1 including the eccentric pulley assembly of the DC motor 2 mounted to the slotted ring 54. As illustrated in FIG. 5 of the front view and FIG. 6 of the side view, the slot bore 57 is oval or elliptical. As particularly illustrated in FIG. 5, the oval or elliptical slotted bore 57 has a height in the vertical direction and a length in horizontal direction, wherein the height matches the outside diameter of the ball bearing 8, and the length is larger than the diameter of the bearing so that the ball bearing 8 can move in the horizontal direction. Therefore, the ball bearing 8 not only is freely inserted into the slotted bore 57, but also can freely move inside of the slotted bore in the horizontal direction when the bearing turns. As illustrated, after the bearing 8 has been inserted into the slotted ring 54, a top screw 278*b* and two bottom screws 279*b* and 280*b* shown in FIG. 3 can lock the paper sheet tray 5 to the stand 1 after being respectively threaded to respective top and bottom rubber supports 278*a*, and 279*a* and 280*a* on the motor support plate 27 of the stand 1.

Referring to FIGS. 4, 5 and 6 and further as disclosed in FIG. 1, a mechanism of a vertical vibration is illustrated for the sheet tray 5 of the present invention vibratory sheet jogger 100. As illustrated, the ball bearing 8 is inserted into the slotted bore 57 of the slotted ring 54, wherein the ball bearing 8 at its central bore 81 coaxially connects onto the shoulder 72 of the eccentric pulley 7 which has the eccentric bore 73; where the front end 261 of the shaft 26 of the motor 2 is fixed into the bore 73 of the eccentric pulley 7. Since the center of the bore 73 is off center from the rotational axis of the pulley, mechanical positions of the outer circumference of the ball bearing 8 are also eccentric relative to the shaft 26 of a running motor 2, thereby resulting in an eccentric motion. It will be appreciated that the eccentric motion is ineffective to jog the slotted ring 54 when the mechanical eccentric positions of the ball bearing 8 align in a horizontal position shown in FIG. 5. This is because that the length of the slotted bore 57 is larger than the outside diameter of the ball bearing 8. However, the eccentric motion is effective to make the slotted ring 54 move up or down when the eccentric mechanical positions of the ball bearing align in an up or down position in the vertical direction, since the height of the slotted bore 57 matches the outside diameter of the ball bearing 8. It will be appreciated that the sheet tray 5 would be also correspondingly moved up and down since the sheet tray is mechanically affixed to the slotted ring 54. It will be further appreciated that the sheet tray 5 would vibrate in the vertical direction due to the eccentric motion of the eccentric pulley 7 driven by the DC motor 2, where the motor rotates. In a preferred embodiment, the motor rotates 45 times per second.

Figure 7:
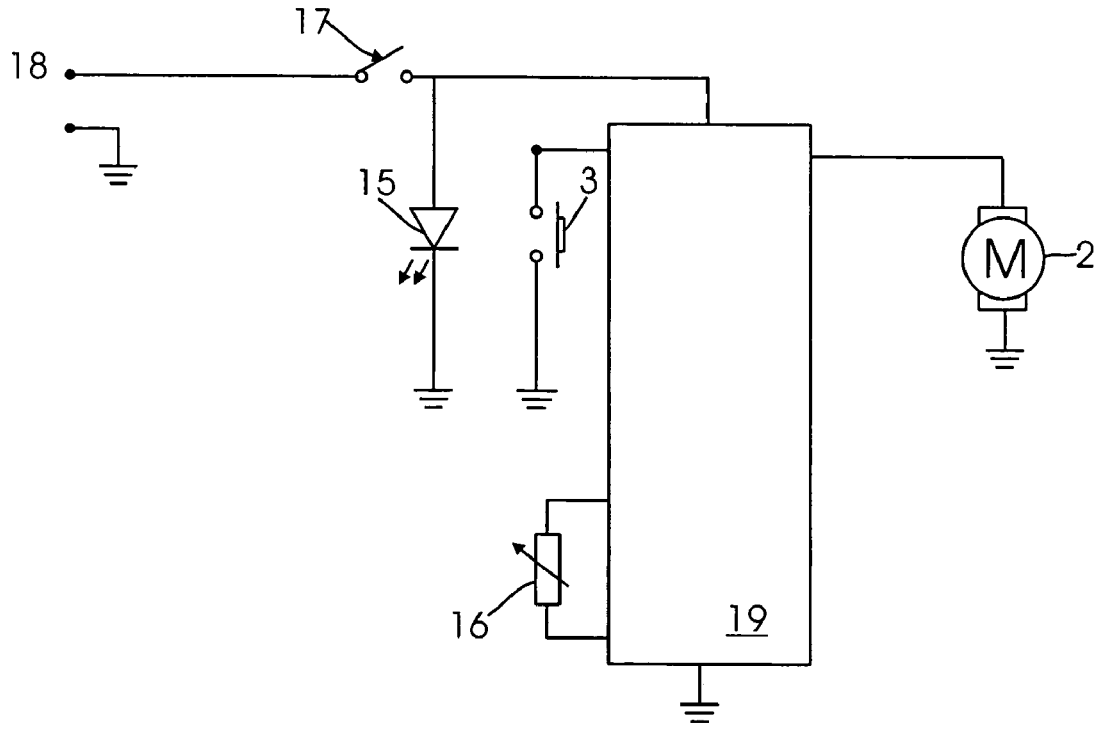
FIG. 7 is a schematic diagram disclosing the connection of electric components used in the present invention vibratory sheet jogger.

Referring to FIG. 7, there is illustrated a schematic diagram for connection of electric components in the present invention vibratory sheet jogger 100. As illustrated, an external DC power is supplied to the jogger 100 through an electrical connection 18 of a plug of a AC/DC power adaptor, wherein the DC power plug 18*a* is shown in FIG. 2. The DC power through connection of a power switch 17 is further supplied to electronic circuits 19 on the printed circuit board 121 including a DC motor control circuit for instructing the motor to turn on or off and a timer circuit for controlling vibratory time of the jogger 100. As illustrated in FIG. 7, an adjustable potentiometer 16 for adjusting the vibratory time is connected to the timer circuit of the circuits 19. It will be appreciated that the vibratory time of the jogger can be chosen through adjusting the potentiometer 16, wherein a knob 16*a* of the potentiometer is illustrated in FIG. 2 for such purpose. In a preferred embodiment, the vibratory time is selected from 3 to 17 seconds. It will be further appreciated that the present invention vibratory sheet jogger 100 is at a work-ready state after a power switch 17 is switched on, wherein the knob 17*a* of the power switch is also shown in FIG. 2. As illustrated, the LED 15 on the top of the switch 3 lights up after the power connection. The vibratory sheet jogger 100 starts jogging after the jogger switch 3 is pressed since pressing said switch activates the DC motor control circuits to start the motor 2, and also initiates the time control circuit. In a preferred embodiment, the jogger switch 3 is a type of spring switch. The present invention vibratory sheet jogger 100 will automatically stop jogging after the predetermined jogging time is reached, wherein the DC motor control circuit is instructed to turn off the power of the motor 2. The preferred jogging time is between 3 and 14 seconds.

The key innovation of the present invention is an eccentric pulley with a slightly off-center axis of rotation connected to a ball bearing which in turn is connected to a non-round (generally oval or elliptical) opening in a sheet jogger so that when a motor causes the eccentric pulley to rotate slightly off-center, it causes the ball bearing to move horizontally in the non-round opening on the sheet jogger to thereby cause the sheet jogger to move in the up and down vertical direction to jog the sheets of paper or checks placed within the tray so that the sheets of paper or checks are jogged, separated and aligned.

Defined in detail, the present invention is a vibratory sheet jogger having a stand to elastically support a sheet tray which receives sheets of paper, the stand having a base cover and body cover, wherein the body cover maintains a plate that supports a DC motor through a DC motor supporting plate, the DC motor plate further elastically connects the base of the sheet tray having an open top end, the invention comprising: (a) an eccentric pulley having a cylindrical head coaxially connected with a cylindrical shoulder, wherein the diameter of the head is larger than the diameter of the shoulder, the cylindrical head having an eccentric cylindrical bore where the rotational axis of the bore is parallel to the rotational axis of the pulley head but is positioned at an off-center location relative to the center of rotation of the cylindrical head, said eccentric bore receives the front end of a shaft of the DC motor, said cylindrical head further comprises a screw threaded hole located at an outer cylindrical surface of the head to transversely connect the eccentric pulley by a screw to the motor shaft, the end of the cylindrical shoulder remote from the cylindrical head having a circular slot which receives a lock washer; (b) a ball bearing having a central bore inserted onto the shoulder of the eccentric pulley, the ball bearing having a width which is smaller than the length of the shoulder of the eccentric pulley; (c) a lock washer to lock the ball bearing onto the eccentric pulley, wherein the lock washer fits onto the circular slot at the end of the shoulder of the eccentric pulley; (d) a slotted ring connected to the back of the sheet tray and having a non-round slotted bore located at the center of the ring, the slotted bore has a height and a length, wherein the height approximately matches the outside diameter of the ball bearing, and the length is larger than the diameter of the bearing, the slotted bore is connected to the ball bearing with the eccentric pulley rotated by the shaft of the DC motor; and (e) when the DC motor is activated so that its shaft rotates the eccentric pulley, the slotted ring is caused to move up and down in the same vertical direction so that the sheet tray is also caused to move up and down which therefore jogs and separates the sheets of paper.

Defined more broadly, the present invention is a vibratory sheet jogger having a stand to elastically support a sheet tray which receives sheets of paper, the stand supporting a DC motor which has a rotating shaft, the invention comprising: (a) an eccentric pulley having a cylindrical head coaxially connected with a cylindrical shoulder, wherein the diameter of the head is larger than the diameter of the shoulder, the cylindrical head having an eccentric cylindrical bore where the rotational axis of the bore is parallel to the rotational axis of the pulley head but is positioned at an off-center location relative to the center of rotation of the cylindrical head, said eccentric bore receives the front end of a shaft of the DC motor; (b) a ball bearing having a central bore inserted onto the shoulder of the eccentric pulley and locked thereon; (c) a slotted ring connected to the back of the sheet tray and having a non-round slotted bore located at the center of the ring, the slotted bore has a height and a length, wherein the height approximately matches the outside diameter of the ball bearing, and the length is larger than the diameter of the bearing, the slotted bore is connected to the ball bearing with the eccentric pulley rotated by the shaft of the DC motor; and (d) when the DC motor is activated so that its shaft rotates the eccentric pulley, the slotted ring is caused to move up and down in the same vertical direction so that the sheet tray is also caused to move up and down which therefore jogs and separates the sheets of paper.

Defined most broadly, the present invention is a vibratory sheet jogger having a stand to elastically support a sheet tray which receives sheets of paper, the stand also supporting a motor which has a shaft, the invention comprising: (a) an eccentric pulley having a cylindrical head coaxially connected with a cylindrical shoulder, wherein the diameter of the head is larger than the diameter of the shoulder, the cylindrical head having an eccentric cylindrical bore where the rotational axis of the bore is parallel to the rotational axis of the pulley head but is positioned at an off-center location relative to the center of rotation of the cylindrical head, said eccentric bore receives a front end of the shaft of the motor; (b) a ball bearing having a central bore inserted onto the shoulder of the eccentric pulley and locked thereon; (c) a slotted ring connected to the back of the sheet tray and having a non-round slotted bore located at the center of the ring, the slotted bore has a height and a length, wherein the height approximately matches the outside diameter of the ball bearing, and the length is larger than the diameter of the bearing, the slotted bore is connected to the ball bearing with the eccentric pulley rotated by the shaft of the motor; and (d) when the DC motor is activated so that its shaft rotates the eccentric pulley, the slotted ring is caused to move up and down in the same vertical direction so that the sheet tray is also caused to move up and down which therefore jogs and separates the sheets of paper.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. The present invention is a vibratory sheet jogger having a stand to elastically support a sheet tray which receives sheets of paper, the stand having a base cover and body cover, wherein the body cover maintains a plate that supports a DC motor through a DC motor supporting plate, the DC motor plate further elastically connects the base of the sheet tray having an open top end, the invention comprising:

a. an eccentric pulley having a cylindrical head coaxially connected with a cylindrical shoulder, wherein the diameter of the head is larger than the diameter of the shoulder, the cylindrical head having an eccentric cylindrical bore where the rotational axis of the bore is parallel to the rotational axis of the pulley head but is positioned at an off-center location relative to the center of rotation of the cylindrical head, said eccentric bore receives the front end of a shaft of the DC motor, said cylindrical head further comprises a screw threaded hole located at an outer cylindrical surface of the head to transversely connect the eccentric pulley by a screw to the motor shaft, the end of the cylindrical shoulder remote from the cylindrical head having a circular slot which receives a lock washer, b. a ball bearing having a central bore inserted onto the shoulder of the eccentric pulley, the ball bearing having a width which is smaller than the length of the shoulder of the eccentric pulley, c. a lock washer to lock the ball bearing onto the eccentric pulley, wherein the lock washer fits onto the circular slot at the end of the shoulder of the eccentric pulley, d. a slotted ring connected to the back of the sheet tray and having a non-round slotted bore located at the center of the ring, the slotted bore has a height and a length, wherein the height approximately matches the outside diameter of the ball bearing, and the length is larger than the diameter of the bearing, the slotted bore is connected to the ball bearing with the eccentric pulley rotated by the shaft of the DC motor; and e. when the DC motor is activated so that its shaft rotates the eccentric pulley, the slotted ring is caused to move up and down in the same vertical direction so that the sheet tray is also caused to move up and down which therefore jogs and separates the sheets of paper.

2. The vibratory sheet jogger in accordance with claim 1 wherein the eccentric bore of the eccentric pulley is positioned at approximately 45/1000 of an inch off the center of the axis of rotation of the eccentric pulley.

3. The vibratory sheet jogger in accordance with claim 1, further comprising a timer electronic circuit to control variation of a jogging time of the vibratory sheet jogger.

4. The vibratory sheet jogger in accordance with claim 3, further comprising a preferred jogging time between 3 to 14 seconds.

5. The vibratory sheet jogger in accordance with claim 1, further comprising an LED, wherein said LED lights up after electric power is supplied to the vibratory sheet jogger.

6. The vibratory sheet jogger in accordance with claim 1 wherein the non-round slotted bore is generally oval in shape.

7. The vibratory sheet jogger in accordance with claim 1 wherein the non-round slotted bore is generally elliptical in shape.

8. The present invention is a vibratory sheet jogger having a stand to elastically support a sheet tray which receives sheets of paper, the stand supporting a DC motor which has a rotating shaft, the invention comprising:

a. an eccentric pulley having a cylindrical head coaxially connected with a cylindrical shoulder, wherein the diameter of the head is larger than the diameter of the shoulder, the cylindrical head having an eccentric cylindrical bore where the rotational axis of the bore is parallel to the rotational axis of the pulley head but is positioned at an off-center location relative to the center of rotation of the cylindrical head, said eccentric bore receives the front end of a shaft of the DC motor;

b. a ball bearing having a central bore inserted onto the shoulder of the eccentric pulley and locked thereon;

c. a slotted ring connected to the back of the sheet tray and having a non-round slotted bore located at the center of the ring, the slotted bore has a height and a length, wherein the height approximately matches the outside diameter of the ball bearing, and the length is larger than the diameter of the bearing, the slotted bore is connected to the ball bearing with the eccentric pulley rotated by the shaft of the DC motor; and d. when the DC motor is activated so that its shaft rotates the eccentric pulley, the slotted ring is caused to move up and down in the same vertical direction so that the sheet tray is also caused to move up and down which therefore jogs and separates the sheets of paper.

9. The vibratory sheet jogger in accordance with claim 8 wherein the eccentric bore of the eccentric pulley is positioned at approximately 45/1000 of an inch off the center of the axis of rotation of the eccentric pulley.

10. The vibratory sheet jogger in accordance with claim 8, further comprising a timer electronic circuit to control variation of a jogging time of the vibratory sheet jogger.

11. The vibratory sheet jogger in accordance with claim 10, further comprising a preferred jogging time between 3 to 14 seconds.

12. The vibratory sheet jogger in accordance with claim 8, further comprising an LED, wherein said LED lights up after electric power is supplied to the vibratory sheet jogger.

13. The vibratory sheet jogger in accordance with claim 8 wherein the non-round slotted bore is generally oval in shape.

14. The vibratory sheet jogger in accordance with claim 8 wherein the non-round slotted bore is generally elliptical in shape.

15. The present invention is a vibratory sheet jogger having a stand to elastically support a sheet tray which receives sheets of paper, the stand also supporting a motor which has a shaft, the invention comprising:

a. an eccentric pulley having a cylindrical head coaxially connected with a cylindrical shoulder, wherein the diameter of the head is larger than the diameter of the shoulder, the cylindrical head having an eccentric cylindrical bore where the rotational axis of the bore is parallel to the rotational axis of the pulley head but is positioned at an off-center location relative to the center of rotation of the cylindrical head, said eccentric bore receives a front end of the shaft of the motor;

b. a ball bearing having a central bore inserted onto the shoulder of the eccentric pulley and locked thereon;

c. a slotted ring connected to the back of the sheet tray and having a non-round slotted bore located at the center of the ring, the slotted bore has a height and a length, wherein the height approximately matches the outside diameter of the ball bearing, and the length is larger than the diameter of the bearing, the slotted bore is connected to the ball bearing with the eccentric pulley rotated by the shaft of the motor; and d. when the DC motor is activated so that its shaft rotates the eccentric pulley, the slotted ring is caused to move up and down in the same vertical direction so that the sheet tray is also caused to move up and down which therefore jogs and separates the sheets of paper.

16. The vibratory sheet jogger in accordance with claim 15 wherein the eccentric bore of the eccentric pulley is positioned at approximately 45/1000 of an inch off the center of the axis of rotation of the eccentric pulley.

17. The vibratory sheet jogger in accordance with claim 15, further comprising a timer electronic circuit to control variation of a jogging time of the vibratory sheet jogger.

18. The vibratory sheet jogger in accordance with claim 15, further comprising an LED, wherein said LED lights up after electric power is supplied to the vibratory sheet jogger.

19. The vibratory sheet jogger in accordance with claim 15 wherein the non-round slotted bore is generally oval in shape.

20. The vibratory sheet jogger in accordance with claim 15 wherein the non-round slotted bore is generally elliptical in shape.

* * * * *